US009366096B2

(12) United States Patent
Bowley et al.

(10) Patent No.: US 9,366,096 B2
(45) Date of Patent: Jun. 14, 2016

(54) JOINT SOLIDIFICATION TOOL

(71) Applicant: TESCO CORPORATION, Houston, TX (US)

(72) Inventors: Ryan Thomas Bowley, Calgary (CA); Edgar Fernando Yajure, Calgary (CA)

(73) Assignee: TESCO CORPORATION, Houston, TX (US)

( * ) Notice: Subject to any disclaimer, the term of this patent is extended or adjusted under 35 U.S.C. 154(b) by 609 days.

(21) Appl. No.: 13/664,258

(22) Filed: Oct. 30, 2012

(65) Prior Publication Data

US 2014/0116722 A1 May 1, 2014

(51) Int. Cl.
*E21B 19/16* (2006.01)
*E21B 19/00* (2006.01)

(52) U.S. Cl.
CPC ..... *E21B 19/16* (2013.01); *E21B 19/00* (2013.01)

(58) Field of Classification Search
CPC ..... E21B 19/00; E21B 19/16
See application file for complete search history.

(56) References Cited

U.S. PATENT DOCUMENTS

| | | | | |
|---|---|---|---|---|
| 7,437,974 | B2 | 10/2008 | Slettedal et al. | |
| 8,235,104 | B1 | 8/2012 | Sigmar et al. | |
| 2004/0174163 | A1* | 9/2004 | Rogers | E21B 19/165 324/228 |
| 2004/0251050 | A1 | 12/2004 | Shahin et al. | |
| 2006/0174729 | A1* | 8/2006 | Slettedal et al. | 81/57.34 |
| 2008/0217067 | A1* | 9/2008 | Ge | 175/85 |
| 2012/0297933 | A1* | 11/2012 | Lavalley et al. | 81/57.34 |

OTHER PUBLICATIONS

International Search Report & Written Opinion for International Application No. PCT/US2013/065375 mailed Mar. 25, 2015.

* cited by examiner

*Primary Examiner* — Robert E Fuller
*Assistant Examiner* — Steven MacDonald
(74) *Attorney, Agent, or Firm* — Fletcher Yoder, P.C.

(57) ABSTRACT

Embodiments of the present disclosure include a system having a clamping mechanism configured to apply a force on a first tool joint and a second tool joint, wherein the clamping mechanism is configured to transfer a torque from the first tool joint to the second tool joint, and the clamping mechanism is configured to rotate about an axis of the first and second tool joints.

10 Claims, 5 Drawing Sheets

JOINT SOLIDIFICATION TOOL

BACKGROUND

Embodiments of the present disclosure relate generally to the field of drilling and processing of wells. More particularly, present embodiments relate to a system and method for solidifying or reinforcing tool joints of certain coupled tubular sections to facilitate coupling or decoupling of other tubular sections.

Top drives are typically utilized in well drilling and maintenance operations, such as operations related to oil and gas exploration. In conventional oil and gas operations, a well is typically drilled to a desired depth with a drill string, which includes drill pipe and a drilling bottom hole assembly (BHA). During a drilling process, the drill string may be supported and hoisted about a drilling rig by a hoisting system for eventual positioning down hole in a well. As the drill string is lowered into the well, a top drive system may rotate the drill string to facilitate drilling. The drill string may include multiple sections of tubular that are coupled to one another by threaded connections or tool joints. In traditional operations, the sections of tubular are coupled together and decoupled from one another using hydraulic tongs.

BRIEF DESCRIPTION

In a first embodiment, a joint solidification tool, a clamping mechanism of the joint solidification tool, wherein the clamping mechanism is configured to apply a compressive force on a first tool joint and a second tool joint, and a support structure of the joint solidification tool, wherein the support structure is configured to support the clamping mechanism, wherein the clamping mechanism is configured to rotate relative to the support structure and about an axis of the first and second tool joints when the clamping mechanism is in a clamped position.

In a second embodiment, a system includes a clamping mechanism configured to apply a force on a first tool joint and a second tool joint, wherein the clamping mechanism is configured to transfer a torque from the first tool joint to the second tool joint, and the clamping mechanism is configured to rotate about an axis of the first and second tool joints.

In a third embodiment, a method includes reinforcing a first threaded connection between a first tool joint of a first tubular and a second tool joint of a second tubular with a solidification tool clamped about the first tool joint and the second tool joint, driving rotation of the first tubular with a top drive of a drilling rig, transferring rotation of the first tubular to the second tubular via the solidification tool, and disengaging a second threaded connection between a third tool joint of the second tubular and a fourth tool joint of a third tubular, wherein the second threaded connection is axially below the first threaded connection.

DRAWINGS

These and other features, aspects, and advantages of the present invention will become better understood when the following detailed description is read with reference to the accompanying drawings in which like characters represent like parts throughout the drawings, wherein.

Figure 4:
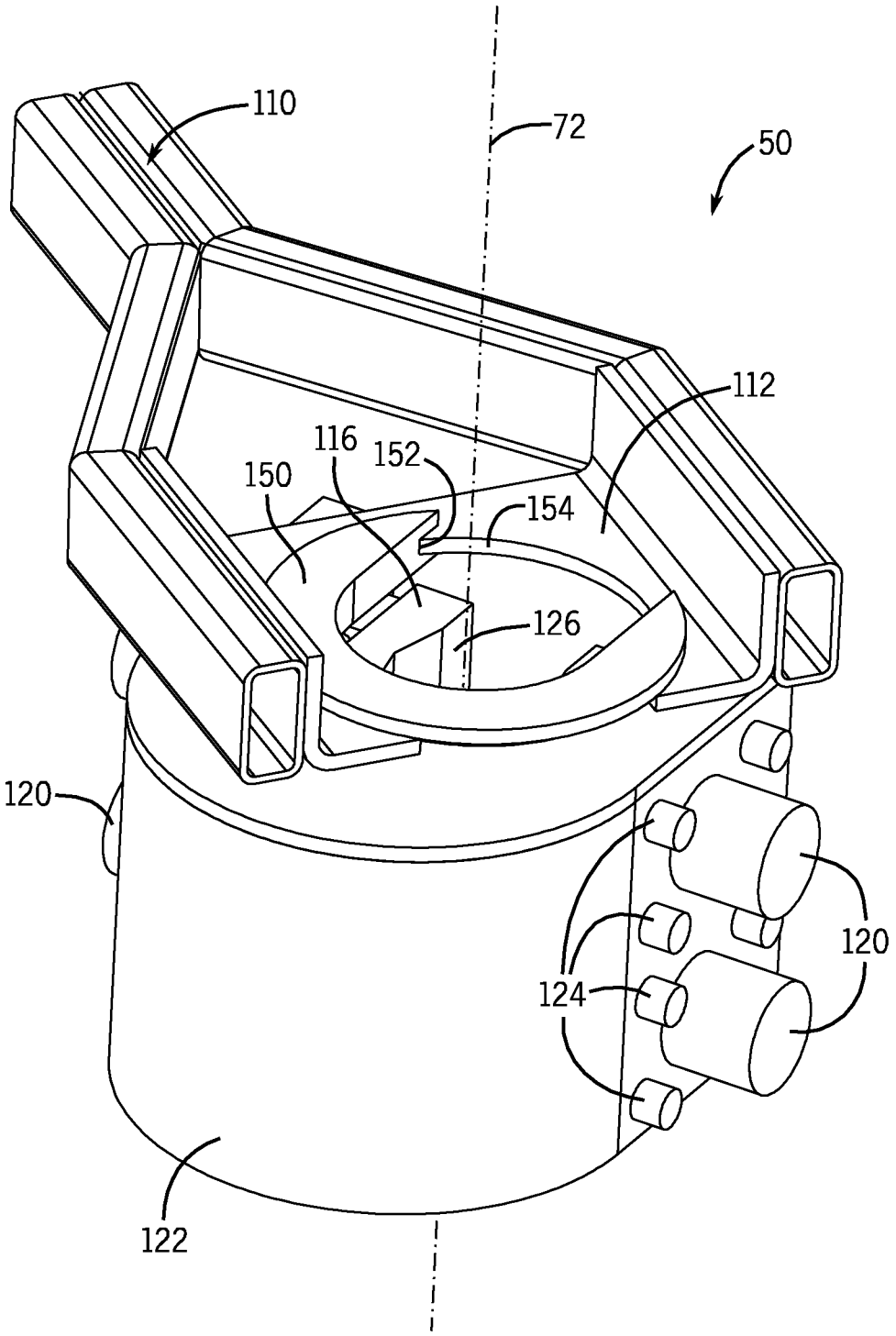
Figure 5:
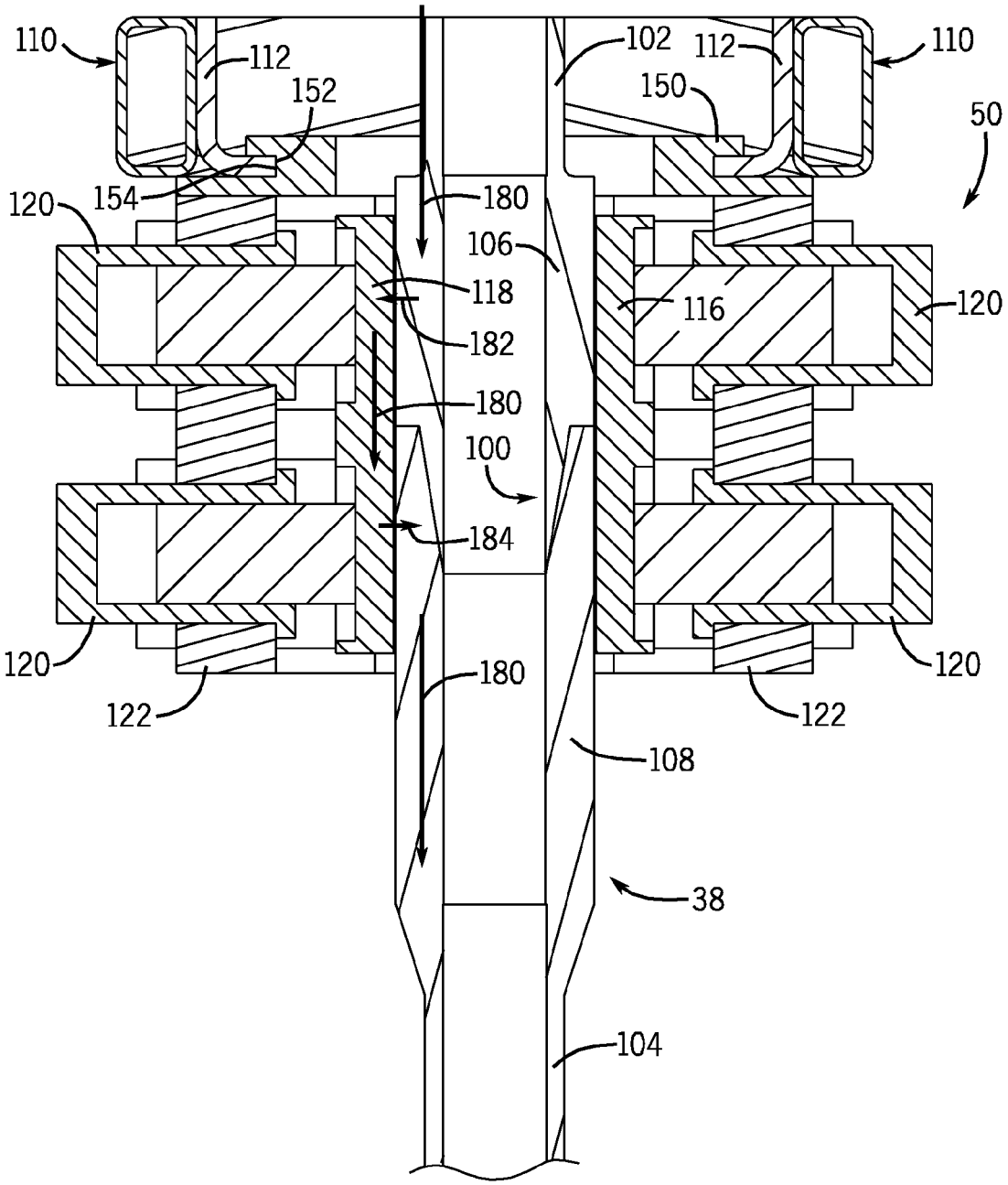

FIG. 4 is a perspective view of an embodiment of a solidification tool, illustrating a capacity of the solidification tool to rotate about an axis of a tubular, in accordance with present techniques; and FIG. 5 is a cross-sectional side view of an embodiment of a solidification tool, illustrating transfer of torque from a first joint of tubular to a second joint of tubular with the solidification tool, in accordance with present techniques.

DETAILED DESCRIPTION

Figure 1:
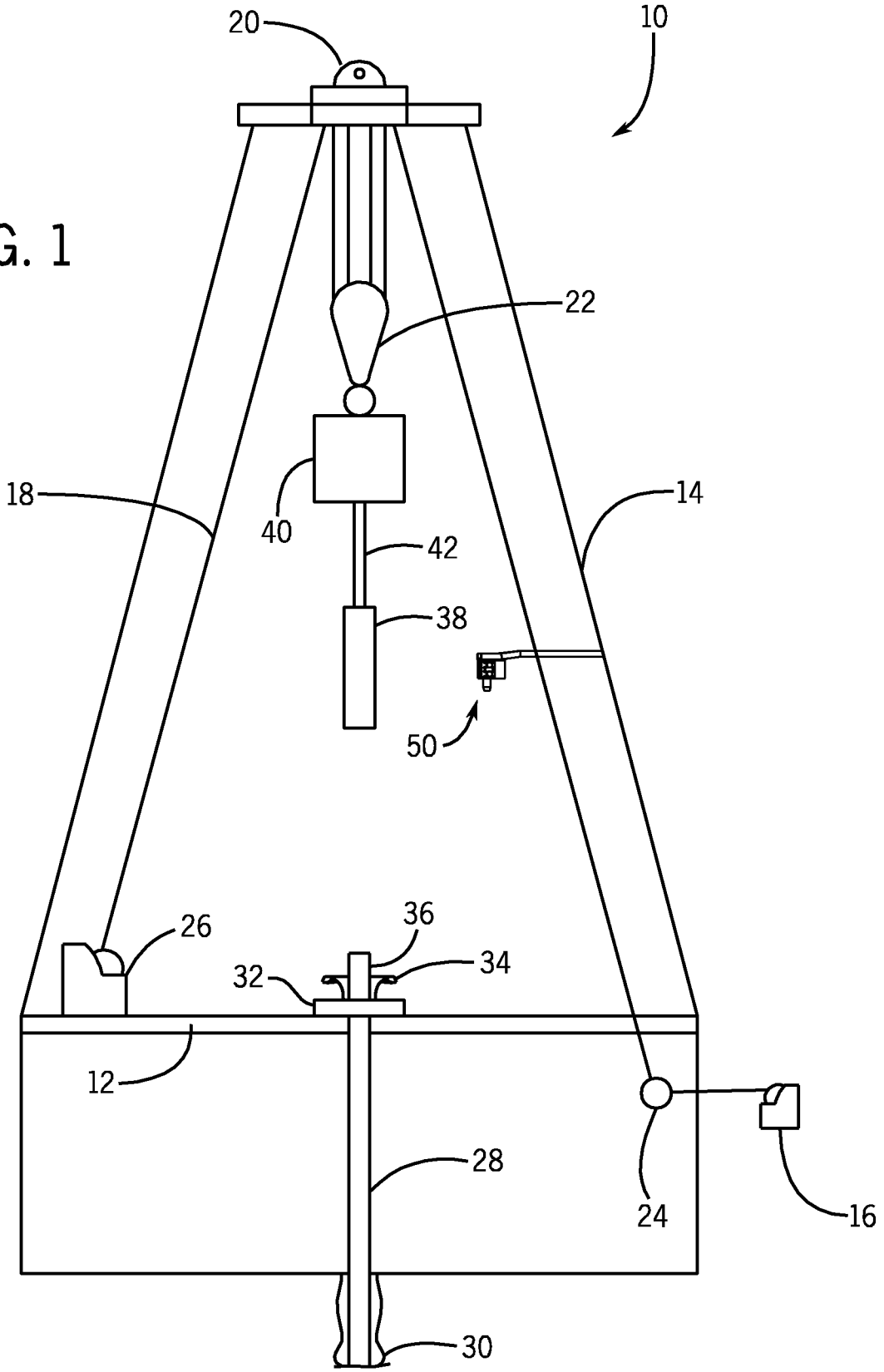
FIG. 1 is a schematic of a drilling rig in the process of drilling a well in accordance with present techniques.

FIG. 1 is a schematic of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34. A portion of the drill string 28 extends above the rig floor 12, forming a stump 36 to which another length of tubular 38 may be added. During operation, a top drive 40, hoisted by the traveling block 22, may engage and position the tubular 38 above the wellbore 30. The top drive 40 may then lower the coupled tubular 38 into engagement with the stump 36 and rotate the tubular 38 such that it connects with the stump 36 and becomes part of the drill string 28. Specifically, the top drive 40 includes a quill 42 used to turn the tubular 38 or other drilling equipment. Also, during other phases of operation of the drilling rig 10, the top drive 40 may be utilized to disconnect and remove sections of the tubular 38 from the drill string 28, as is illustrated in FIG. 1.

The drill string 28 may include multiple sections of threaded tubular 38 that are threadably coupled together. It should be noted that present embodiment may be utilized with drill pipe, casing, or other types of tubular. After setting or landing the drill string 28 in place such that the male threads of one section (e.g., one or more joints) of the tubular 38 and the female threads of another section of the tubular 38 are engaged, the two sections of the tubular 38 may be joined by rotating one section relative to the other section (e.g., in a clockwise direction) such that the threaded portions tighten together. Thus, the two sections of tubular 38 may be threadably joined.

Furthermore, as the drill string 28 is removed from the wellbore 30, the sections of the tubular 38 may be detached by disengaging the corresponding male and female threads of the respective sections of the tubular 38 via rotation of one section relative to the other in a direction opposite that used for coupling. In the manner described below, the top drive 40 may be used to rotate a section of tubular 38 coupled to another section of tubular 38 such that the two sections of the tubular 38 become decoupled. Additionally, as will be appreciated by one skilled in the art, it may be desirable to detach only certain sections of tubular 38 from one another. For example, in certain applications, three sections (e.g., joints) of the tubular 38 may remain coupled to one another. As a result, every third threaded connection between two sections of tubular 38 may be detached or disengaged.

As discussed in detail below, embodiments of the present disclosure include a solidification tool 50 that solidifies or reinforces a threaded connection between two sections of tubular 38, such that the threaded connection does not detach or disengage when one of the sections of tubular 38 is rotated. The solidification tool 50 may be utilized with two or more sections of tubular 38 to establish a fixed section of tubular 38 including the two or more sections (e.g., joints). In this manner, the solidification tool 50 functions to allow the top drive 40 to simultaneously rotate the multiple sections of tubular 38 coupled to one another in the same direction without initiating decoupling between any of the multiple sections that make up the fixed section. Again, this may be achieved by utilizing the solidification tool 50 to secure and reinforce certain threaded connections between sections of tubular 38 to prevent rotation of the tubular sections 38 with respect to one another. Further, while preventing the rotation of certain tubular sections with respect to one another, other sections of coupled tubular are allowed to rotate relative to the fixed section, which results in detachment or disengagement of the other threaded connections from the fixed section.

It should be noted that the illustration of FIG. 1 is intentionally simplified to focus on the top drive 40 and the solidification tool 50. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

Figure 2:
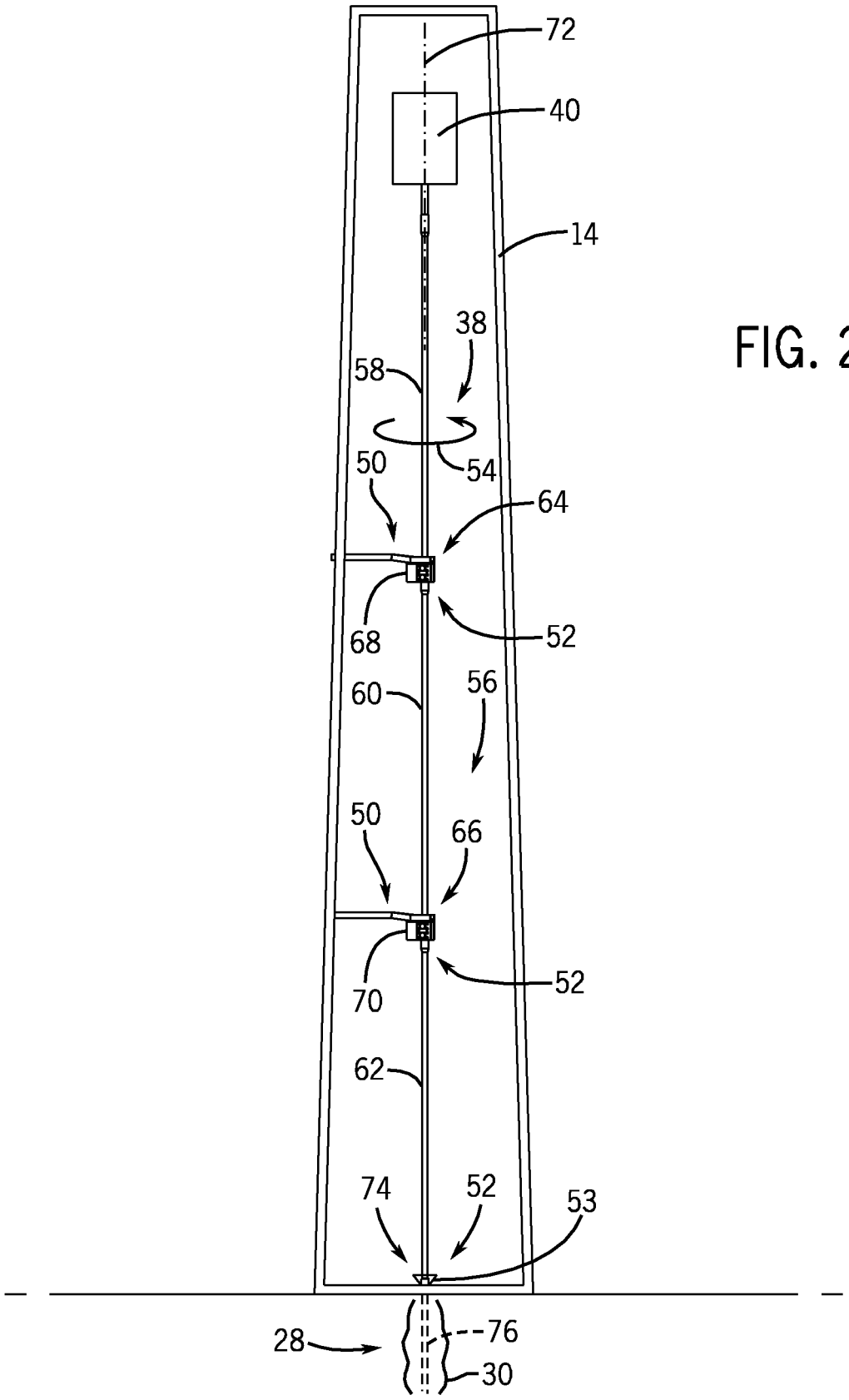
FIG. 2 is a simplified schematic of a portion of the drilling rig, illustrating a solidification tool for use in reinforcing threaded couplings between sections or joints of tubular, in accordance with present techniques.

FIG. 2 is a simplified schematic of a portion of the drilling rig 10, illustrating the solidification tool for use in reinforcing threaded couplings between sections or joints of tubular 38. In this illustrated embodiment, the drill string 28 is in the process of being removed from the wellbore 30. Specifically, multiple joints of tubular 38, which are threadably connected to one another at tool joints 52, are being removed from the wellbore 30. As such, several of the multiple joints of tubular 38 are being rotated in the same direction using the top drive 40. When disconnecting a coupling between two sections of tubular 38, one joint of tubular 38 may essentially be rotated counter-clockwise (e.g., in a direction 54) relative to the other joint of tubular 38, thereby disconnecting the tool joints 52 of the two joints of tubular 38. For example, in certain embodiments, one joint of tubular 38 (e.g., a bottom joint) may be held in place by a power slip, hydraulic tong, or other clamping mechanism 53, and the top drive 40 may rotate another joint of tubular 38 (e.g., a top joint) in the direction 54, thereby unthreading the threaded connection coupling the two joints of tubular 38. As will be discussed in detail below, in the illustrated embodiment, the three upper joints of tubular 38 are being solidified at their corresponding tool joints 52 by the solidification tools 50, which facilitates simultaneous rotation of the upper three joints in the same direction and detachment of these upper joints, as a unit, from the lower joint, which is illustrated as being captured in the clamping mechanism 53.

When the drill string 28 is removed from the wellbore 30, it may be desirable to disconnect sections of tubular 38 that include multiple joints. In other words, several joints of tubular 38 may be left connected by the tool joints 52 when the drill string 28 is removed from the wellbore 30 in sections. For example, it may be desirable to remove sections of tubular 38 that each includes two or three joints of tubular 38 that remain coupled together and thus limit trip times. The length of each section of tubular 38 kept intact (not decoupled at every joint) may be limited by the rig height. For example, when removing the drill string 28 from the wellbore 30, every second, third, or fourth tool joint 52 may be broken or disconnected depending on joint lengths and the height of the drilling rig 10. In this manner, sections of tubular 38 including multiple joints that remain connected may be set aside for later use with the drilling rig 10. As will be appreciated, this practice may result in faster re-assembly of the drill string 28, when the drill string 28 is assembled for use within the wellbore 30 at a later time.

To block the disassembly of certain tool joints 52 when the drill string 28 is removed from the wellbore 30, one or more solidification tools 50 may be used. More specifically, the solidification tool 50 may be used to secure or solidify the tool joint 52 between two joints of tubular 38, thereby blocking the disengagement or disassembly of the tool joint 52. For example, in the illustrated embodiment, a section 56 of tubular 38 having three joints of tubular 38 is being removed from the wellbore 30. That is, the section 56 of tubular 38 includes a first joint 58, a second joint 60, and a third joint 62 of tubular. Moreover, the first and second joints 58 and 60 are coupled by a first tool joint 64 (e.g., a threaded connection between the first and second joints 58 and 60), and the second and third joints 60 and 62 are coupled by a second tool joint 66 (e.g., a threaded connection between the second and third joints 60 and 62). The first tool joint 64 is reinforced by a first solidification tool 68, and the second tool joint 66 is reinforced by a second solidification tool 70. In some embodiments, the features of the first and second solidification tools 68 and 70 may be integrated into a single solidification tool.

As discussed in detail below, the solidification tool 50 is configured to clamp the tool joint 52 (e.g., the coupling between two joints of tubular 38) and block rotation of the two joints of tubular 38 relative to one another. In this manner, the solidification tool 50 may block decoupling of the tool joint 52 due to relative rotation of one joint of tubular with respect to the other. In the illustrated embodiment, the first solidification tool 68 clamps the first tool joint 64, thereby blocking rotation of the first and second joints 58 and 60 relative to one another. Similarly, the second solidification tool 70 clamps the second tool joint 66 and blocks rotation of the second and third joints 60 and 62 relative to one another.

Furthermore, the solidification tool 50 is configured to rotate about an axis 72 of the tubular 38. That is, the solidification tool 50 may clamp and reinforce the tool joint 52, while still being able to rotate about the axis 72. As a result, the top drive 40, which is coupled to the first joint 58 of tubular 38, may drive rotation of the section 56 of tubular 38 in the direction 54 (e.g., in the counter-clockwise direction), and the first and second solidification tools 68 and 70 may remain clamped to the first and second tool joints 64 and 66, respectively, thereby blocking unthreading and decoupling of the first and second tool joints 64 and 66.

As mentioned above, the solidification tools 50 enable the disassembly or unthreading of certain tool joints 52 in a section of tubular 38, while reinforcing and maintaining the assembly of other tool joints 52 in the section of tubular 38. In the illustrated embodiment, as the top drive 40 drives rotation of the section 56 of tubular 38 in the direction 54, the first and second tool joints 64 and 66 are secured and reinforced by the first and second solidification tools 68 and 70, while a third tool joint 74 may be unthreaded and disassembled. Specifically, the third tool joint 74 couples the third joint 62 of tubular 38 to a fourth joint 76 of tubular 38, which may be held in place (e.g., stationary) by a power slip or other clamping mechanism 53. In other words, the third tool joint 74 couples the section 56 of tubular 38 to the drill string 28 within the wellbore 30. Therefore, with the first and second solidification tools 68 and 70 positioned and clamped in the manner described above, the entire section 56 of tubular 38 (e.g., the first, second, and third joints 58, 60, and 62 of tubular 38) may be rotated together by the top drive 40 with the first and second tool joints 64 and 66 reinforced and maintained, and the section 56 of tubular 38 may be disconnected from the fourth joint 76, which may be representative of the remaining drill string 28.

As discussed in detail below, the solidification tool 50 may have various configurations, components, and so forth. In the illustrated embodiment, the first and second solidification tools 68 and 70 are supported by the derrick 14. For example, the first and second solidification tools 68 and 70 may be coupled to a mast or other rail of the derrick 14 with a respective arm or other brace. Furthermore, the arm or brace coupling the solidification tool 50 to the derrick 14 may be configured to translate up and/or down along the mast of the derrick 14. In other embodiments, the solidification tool 50 may be a modular or mobile device that may be manually or automatically positioned onto the tool joint 52.

Figure 3:
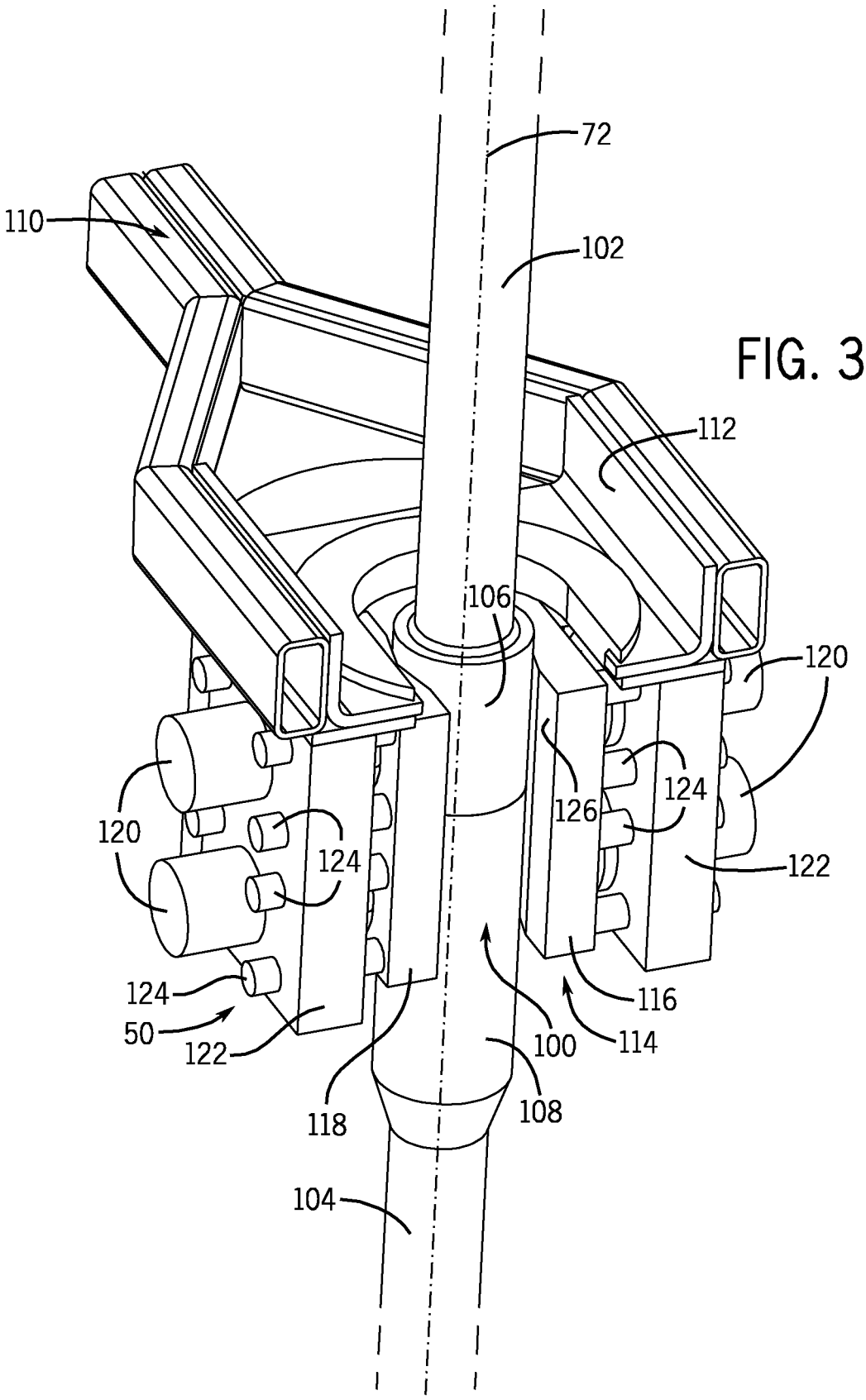
FIG. 3 is a perspective view of an embodiment of a solidification tool, illustrating the solidification tool in a clamped position and securing two engaged tool joints, in accordance with present techniques.

FIG. 3 is a perspective view of an embodiment of the solidification tool 50, illustrating the solidification tool 50 in a clamped position for securing a threaded connection 100 (e.g., tool joints). Specifically, the tool joint 100 couples a first joint 102 of tubular 38 and a second joint 104 of tubular 38. As such, the solidification tool 50 clamps a tool joint 106 of the first joint 102 of tubular 38 and a tool joint 108 of the second joint 104 of tubular 38. In this manner, the solidification tool 50 may block rotation of the first joint 102 relative to the second joint 104, thereby blocking decoupling or disengagement of the threaded connection 100 between the tool joints 106 and 108.

As mentioned above, the solidification tool 50 may have a variety of configurations. In the illustrated embodiment, the solidification tool 50 is supported by an arm 110, which may extend from a rail or mast of the derrick 14 shown in FIGS. 1 and 2. In operation, the arm 110 may translated along the rail or mast of the derrick 14, thereby enabling the solidification tool 50 to be positioned at multiple points along the tubular 38. Additionally, the arm 110 may be configured to rotate or pivot about the mast or rail to enable the solidification tool 50 to swing out and away from the tubular 38 when the solidification tool 50 is not needed. Similarly, the arm 110 may extend telescopically from the mast or rail to position the solidification tool 50 in a desired location. In the illustrated embodiment, the arm 110 is bifurcated and is coupled to a support structure 112 that supports the solidification tool 50. As discussed in detail below with respect to FIG. 4, the support structure 112 enables the solidification tool 50 to rotate about the axis 72 of the tubular 38 while the solidification tool 50 is clamped about the threaded connection 100 (e.g., the tool joints 102 and 108).

The solidification tool 50 includes a caliper assembly 114, which clamps about the threaded connection 100. That is, the caliper assembly 114 clamps onto the tool joints 106 and 108 of the first and second joints 102 and 104. Specifically, the caliper assembly 114 includes a first clamping plate 116 and a second clamping plate 118, where the first and second clamping plates 116 and 118 are positioned opposite one another about the threaded connection 100. In the manner described below, the first and second clamping plates 116 and 118 apply a compressive, radially inward force on the tool joints 106 and 108 at the threaded connection 100, thereby gripping the tool joints 106 and 108 and the threaded connection 100.

In the illustrated embodiment, the compressive force applied by the first and second clamping plates 116 and 118 is provided by hydraulic pistons 120. Specifically, two hydraulic pistons 120 operate to force each of the first and second clamping plates 116 and 118 radially inward toward the tool joints 106 and 108. While the illustrated embodiment includes two hydraulic pistons 120 for each of the first and second clamping plates 116 and 118, other embodiments may include any suitable number of hydraulic pistons 120. As shown, the hydraulic pistons 120 are supported by an outer frame 122 of the solidification tool 50. In certain embodiments, a hydraulic fluid may be supplied to the hydraulic pistons 120 through a conduit that may be routed through the outer frame 122 and/or the arm 110 to a hydraulic fluid source. The outer frame 122 further supports guide rails 124 that extend to from the outer frame 122 to each of the first and second clamping plates 116 and 118. The guide rails 124 serve to align and guide the first and second clamping plates 116 and 118 radially inward as the hydraulic pistons 120 force the first and second clamping plates 116 and 118 toward the tool joints 106 and 108.

As will be appreciated, the solidification tool 50 may include other components not detailed in the embodiment shown in FIG. 3. For example, the first and second clamping plates 116 and 118 may include one or more surface treatments to improve the gripping or clamping ability of the solidification tool 50. For example, a contact surface 126 of the first and second clamping plates 116 and 118 may include teeth, knurls, a surface coating, or other surface treatment configured to increase friction between the first and second clamping plates 116 and 118 and the tool joints 106 and 108. In this manner, the solidification tool 50 may further block rotation of the tool joints 106 and 108 relative to one another.

Furthermore, as mentioned above, the solidification tool 50 may have other configurations, components, and so forth. For example, in certain embodiments, the solidification tool 50 may have other numbers of clamping plates or surfaces. Additionally, the force applied by the clamping plates or surfaces may be provided by other mechanisms. For example, compressive and/or radially inward forces may be provided by one or more springs, which may be pre-loaded, pneumatic pistons, magnets, electromagnetic systems, or other force-generating systems. Additionally, while the illustrated embodiment of the solidification tool 50 is supported by the arm 110 and the derrick 14, other embodiments of the solidification tool 50 may not include the arm 110 or other support structure. Indeed, the solidification tool 50 may also be a modular or mobile system that couples to the tool joints 106 and 108 and moves freely with the tool joints 106 and 108.

FIG. 4 is a perspective view of the embodiment of the solidification tool 50 shown in FIG. 3, illustrating rotation of the solidification tool 50 about the axis 72 of the tubular 38. For illustrative purposes, the tubular 38 and the first and second joints 102 and 104 are not shown in FIG. 4. Additionally, the illustrated embodiment includes similar elements and element numbers as the embodiment shown in FIG. 3.

As mentioned above, the solidification tool 50 may be configured to rotate along the axis 72 of the tubular 38 to which the solidification tool 50 is clamped. In this manner, when the solidification tool 50 is clamped to the tool joints 106 and 108, the solidification tool 50 rotates with the tubular 38 (e.g., the first and second joints 102 and 104 and the tool joints 106 and 108) as the tubular 38 is rotated by the top drive 40. As will be appreciated by those skilled in the art, the rotating capability of the solidification tool 50 reduces the reactive torque acting on the tubular 38 by the solidification tool 50 when the top drive 40 is rotating the tubular 38.

As shown, the outer frame 122 of the solidification tool 50 includes an upper lip 150 that forms a retaining track 152 and rests on the support structure 112. Additionally, the upper lip 150 extends over the support structure 112, such that an inner edge 154 of the support structure 112 extends through the retaining track 152. As a result, the support structure 112 supports the outer frame 122 of the solidification tool 50 and enables a clamping portion of the solidification tool 50 to rotate about the axis 72 of the tubular 38.

In certain embodiments, the solidification tool 50 may be spring loaded, such that the outer frame 122 of the solidification tool 50 returns to an original position (e.g., the position of the outer frame 122 shown in FIG. 3) after an amount of rotation about the axis 72 of the tubular 38. In other words, after the solidification tool 50 reinforces a particular tool joint 52 and the top drive 40 drives rotation of the tubular 38 to break or disengage a different tool joint 52, the solidification tool 50 may release the caliper assembly 114 from clamping the particular tool joint 52, and the spring loaded outer frame 122 of the solidification tool 50 may automatically rotate back to an original position (e.g., the position of the outer frame 122 shown in FIG. 3). However, other embodiments of the solidification tool 50 may not include such a mechanism. For example, in modular or mobile embodiments of the solidification tool, the solidification tool 50 may simply be manually removed from the tool joint 52 that was reinforced after a different tool joint 52 was disassembled or disengaged.

FIG. 5 is a cross-sectional side view of the embodiment of the solidification tool 50 shown in FIG. 4, illustrating a path of torque transfer between the tool joint 106, the solidification tool 50, and the tool joint 108. The illustrated embodiment includes similar elements and element numbers as the embodiment shown in FIG. 4.

As discussed in detail above, the solidification tool 50 reinforces and secures the threaded connection 100 between tool joints 106 and 108 of a tubular 38. More specifically, as the top drive 40 rotates the tubular 38, which may include multiple joints of pipe coupled to one another by tool joints 52, the solidification tool 50 transfers the torque from one joint to another joint. For example, in the illustrated embodiment, as the top drive 40 drives rotation of the first joint 102, which is coupled to the tool joint 106, torque within the first joint 102 of tubular 38 and the tool joint 106 is transferred to the solidification tool 50, as indicated by arrow 182. More specifically, the torque 180 is transferred to the clamping mechanisms (e.g., the second clamping plate 118) of the solidification tool 50. Thereafter, as the clamping mechanisms grip both of the tool joints 106 and 108 in the manner described above, the torque is transferred from the clamping mechanisms (e.g., the second clamping plate 118) to the tool joint 108 and the second joint 104 of tubular 38, as indicated by arrow 184. As the torque generated by the top drive 40 is transferred from the first joint 102 to the second joint 104 by the solidification tool 50, the threaded connection 100 is maintained and disengagement or disassembly of the tool joints 106 and 108 is blocked.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a joint solidification tool;

a clamping mechanism of the joint solidification tool, wherein the clamping mechanism is configured to apply a compressive force on a first tool joint and a second tool joint simultaneously, and the clamping mechanism comprises:

a first clamping plate;

a second clamping plate;

a first plurality of hydraulic pistons configured to apply a first actuation force to the first clamping plate; and a second plurality of hydraulic pistons is configured to apply a second actuation force to the second clamping plate, wherein the first and second clamping plates are disposed opposite one another about the first tool joint and the second tool joint, each of the first and second pluralities of hydraulic pistons is configured to be actuated in a direction generally perpendicular to a central axis of the first and second tool joints, the first plurality of hydraulic pistons is aligned along a first clamping mechanism axis relative to one another, and the second plurality of hydraulic pistons is aligned along a second clamping mechanism axis relative to one another; and a support structure of the joint solidification tool, wherein the support structure is configured to support the clamping mechanism, wherein the clamping mechanism is configured to rotate relative to the support structure and about an axis of the first and second tool joints when the clamping mechanism is in a clamped position, wherein a first hydraulic piston of the first plurality of hydraulic pistons is radially aligned with the first tool joint relative to the central axis of the first and second tool joints when the clamping mechanism is in a clamped position, and a second hydraulic piston of the first plurality of hydraulic pistons is radially aligned with the second tool joint relative to the central axis of the first and second tool joints when the clamping mechanism is in a clamped position.

2. The system of claim 1, wherein the first and second clamping plates each comprise a surface treatment configured to increase friction between the first and second clamping plates and the first and second tool joints.

3. The system of claim 1, comprising an arm coupled to the support structure, wherein the arm is configured to couple to a drilling rig.

4. The system of claim 3, wherein the arm is configured to pivot about a derrick of the drilling rig or telescopically extend from the derrick of the drilling rig.

5. The system of claim 1, comprising the first tool joint and the second tool joint, wherein the first and second tool joints are coupled to one another by a threaded connection.

6. A system, comprising:

a clamping mechanism configured to apply a force on a first tool joint and a second tool joint simultaneously and at a location where the first tool joint and the second tool joint are coupled to one another, wherein the clamping mechanism is configured to transfer a torque from the first tool joint to the second tool joint, the clamping mechanism is configured to rotate about an axis of the first and second tool joints, and the clamping mechanism comprises:

a plurality of clamping surfaces configured to apply a radially inward force on the first and second tool joints;

a first plurality of hydraulic pistons configured to apply a first radially inward force on a first clamping surface of the plurality of clamping surfaces; and a second plurality of hydraulic pistons configured to apply a second radially inward force on a second clamping surface of the plurality of clamping surfaces, wherein each of the first and second pluralities of hydraulic pistons is configured to actuate in a direction generally perpendicular to a central axis of the first and second tool joints, the first plurality of hydraulic pistons is aligned relative to one another along a first axis generally parallel to the central axis, and the second plurality of hydraulic pistons is aligned relative to one another along a second axis generally parallel to the central axis, wherein a first hydraulic piston of the first plurality of hydraulic pistons is radially aligned with the first tool joint relative to the central axis of the first and second tool joints when the clamping mechanism is in a clamped position, and a second hydraulic piston of the first plurality of hydraulic pistons is radially aligned with the second tool joint relative to the central axis of the first and second tool joints when the clamping mechanism is in a clamped position.

7. The system of claim 6, wherein the clamping mechanism comprises a support structure configured to support the clamping mechanism, and the clamping mechanism is configured to rotate relative to the support structure.

8. The system of claim 6, wherein the radially inward force is generated by at least one spring.

9. The system of claim 6, wherein the clamping mechanism is coupled to a derrick of a drilling rig by an arm, and the arm is configured to rotate, pivot, or extend from the derrick.

10. The system of claim 6, comprising the first and second tool joints, wherein the first and second tool joints are coupled to one another by a threaded connection.

* * * * *